United States Patent [19]

Maynard

[11] Patent Number: 4,850,899

[45] Date of Patent: Jul. 25, 1989

[54] CONNECTOR FOR INTERFACING A DISK DRIVE WITH A COMPUTER

[76] Inventor: Scott D. Maynard, 270 Cagney La. #304, Newport Beach, Calif. 92663

[21] Appl. No.: 208,463

[22] Filed: Jun. 20, 1988

[51] Int. Cl.[4] ..... H01R 15/18

[52] U.S. Cl. ..... 439/628

[58] Field of Search ..... 439/628–637

[56] References Cited

U.S. PATENT DOCUMENTS 3,409,860 11/1968 Kirby ..... 439/628

4,225,209 9/1980 Hughes ..... 439/628

*Primary Examiner*—Joseph H. McGlynn

*Attorney, Agent, or Firm*—Morland C. Fischer

[57] ABSTRACT

A connector for interfacing a disk drive, into which a floppy disk is to be loaded, with a controller card of a personal computer. The connector replaces the printed circuit board which has previously been used to interface the disk drive and computer. More particularly, the connector includes socket and plug portions which emulate the box connector and edge card, respectively, of the conventional circuit board interface. Accordingly, and by virtue of the presently described connector, the disk drive may be more directly and reliably interfaced with the computer while eliminating the conventional printed circuit board and the relatively high cost and space consumption that are characteristically associated therewith.

15 Claims, 3 Drawing Sheets

FIG. 7
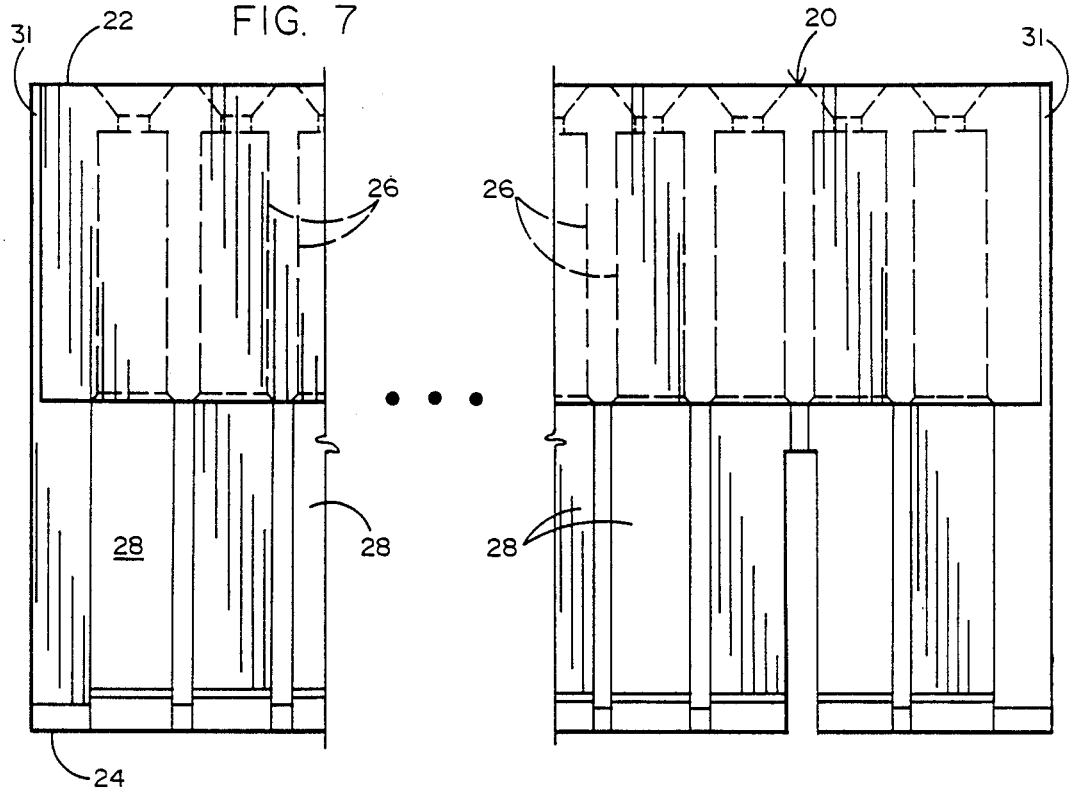
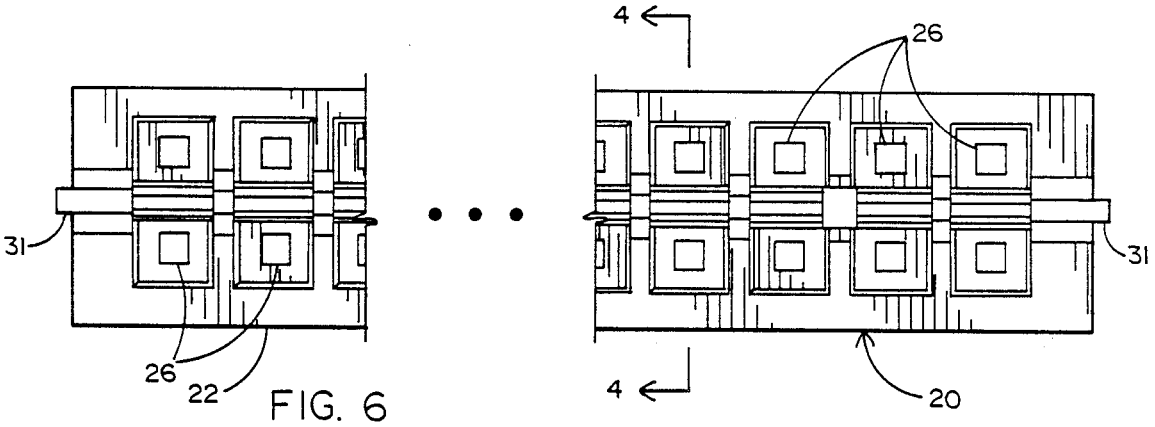
FIG. 6

CONNECTOR FOR INTERFACING A DISK DRIVE WITH A COMPUTER

BACKGROUND OF THE INVENTION

1. Field of the Invention

This invention relates to a connector which has particular application for interfacing a disk drive, into which a floppy disk is to be loaded, with a controller card of a personal computer while replacing the conventional printed circuit board interface which has been previously used but is undesirably characterized by relatively high production cost and space consumption.

2. Prior Art

The typical interconnection of a conventional printed circuit board between a disk drive and a personal computer is best described while referring to FIG. 1 of drawings. In FIG. 1, the circuit board 1 is shown having a machined surface 2 formed at one end thereof and the bent pins of a box connector 4 soldered to the opposite end. The machined surface 2 includes an array of flat, parallel aligned contacts 6 and is commonly referred to as an edge card. The contacts 6 of the edge card 2 are connected via a printed circuit 8 formed on circuit board 1 to respective soldered junctions with the pins of the box connector 4. The output pins of a shrouded header 10, which header is associated with a conventional disk drive 12, are received within respective cavities of the box connector 4. Moreover, the flat contacts 6 of the edge card 2 are received within a receptacle at a conventional ribbon edge card connector 14, which connector terminates a flat ribbon cable 16. As will be known to those skilled in the art, the ribbon cable 16 is electrically connected to a controller card (not shown) which is then connected to a personal computer. Accordingly, the disk drive 12 is connected to the ribbon edge card connector 14 via the printed circuit 8 of circuit board 1 and the box connector 4 and edge card 2 which are located at opposite ends thereof.

However, the typical interconnection of the circuit board 1 in FIG. 1 results in the added cost of a box connector 4 and the corresponding labor to solder the bent pins thereof to the printed circuit 8. Likewise, the machining of the edge card 2 further contributes to the cost of connecting disk drive 12 to the computer. Of course, the presence of the circuit board 1, itself, consumes space and increases cost. Moreover, the interconnection of circuit board 1 between the disk drive and computer increases the risk of defects and the chance of rejection.

It would therefore be desirable to eliminate the circuit board 1, altogether, along with its edge card 2, box connector 4 and printed circuit 8, whereby to reduce both labor and component costs. Thus, the disk drive 12 could be more easily and reliably connected to a computer controller card while conserving space and reducing the risk of rejection due to a manufacturing or assembly defect.

Examples of conventional connector interfaces are available by way of the following U.S. patents:

| | |
|---|---|
| 4,239,319 | December 16, 1980 |
| 4,533,202 | August 6, 1985 |
| 4,538,877 | September 3, 1985 |

However, none of these connector interfaces is described as emulating, and thereby replacing, the conventional printed circuit board interface or as having application in a conversion kit for substituting a disk drive in a personal computer.

SUMMARY OF THE INVENTION

In general terms, a connector interface is disclosed by which a disk drive may be more directly and reliably connected to a personal computer. The connector replaces the conventional integrated circuit board which was previously used to interface the disk drive with the computer. By virtue of the foregoing, the cost and space consumption commonly associated with the conventional circuit board may be reduced. The presently disclosed connector has particular application within a conversion kit or in the retrofit market where a $3\frac{1}{2}$ inch disk drive is to be substituted for the $5\frac{1}{4}$ inch disk drive which is now common to most home computers.

The connector of the present invention includes an insulating body having a socket portion in which a plurality of cavities are formed. The cavities are spaced from one another and arranged in a pair of parallel aligned rows. The socket portion emulates and replaces the box connector of the conventional printed circuit board interface. The connector also includes a relatively narrow plug portion that is sized so as to be received within an electrical receptacle of a ribbon edge card connector. The ribbon edge card connector is connected to the computer by way of a ribbon cable. The plug portion of the connector emulates and replaces the edge card of the conventional printed circuit board. A series of longitudinally extending channels are formed in the plug member for receiving the contact members of the connector. The channels are spaced from one another and arranged in a pair of parallel aligned rows at opposite sides of the plug portion.

More particularly, the connector includes a plurality of electrically conductive contacts. Each contact includes a barrel end which is located within a cavity of the socket portion and is adapted to receive a respective output pin from the disk drive when such pin is inserted within said cavity. Each contact also includes a flat blade end which is located within a respective channel formed in the plug member and is aligned to engage a corresponding terminal of the ribbon edge card connector when the plug member is inserted within the receptacle thereof. The blade ends of the contacts emulate and replace the printed circuit of the conventional printed circuit board interface. In the assembled relationship, the contacts are spaced from one another and arranged in a pair of parallel aligned rows, such that the blade ends of contacts in the first row lie in spaced opposition to the blade ends of the contacts in the second row. Accordingly, the presently disclosed connector interfaces the disk drive with the computer via the ribbon edge card connector and ribbon cable while eliminating the conventional printed circuit board and the disadvantages that are inherent therewith.

BRIEF DESCRIPTION OF THE DRAWINGS

FIG. 6 is an end view of the connector interface; and

FIG. 7 is a top view of the connector interface without the contacts of FIG. 5.

DESCRIPTION OF THE PREFERRED EMBODIMENT

Figure 1:
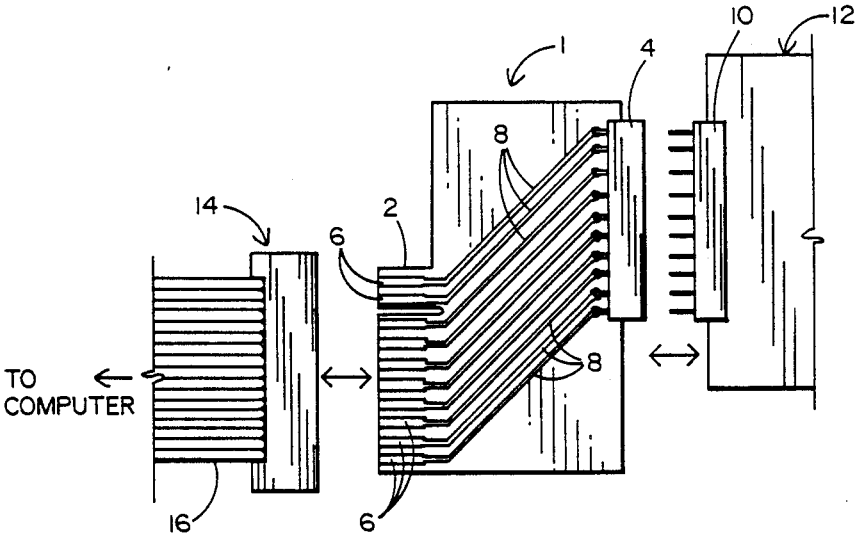
FIG. 1 (PRIOR ART)
FIG. 1 illustrates the conventional printed circuit board interface between a disk drive and a home computer.
Figure 2:
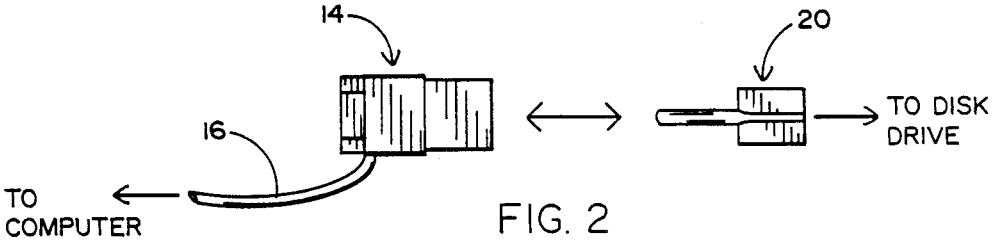
FIG. 2 illustrates the connector interface of the present invention for eliminating the conventional printed circuit board interface of FIG. 1 and more directly connecting the disk drive to the computer.

The connector 20 which forms the present invention for interfacing a disk drive with a personal computer is best described while referring to FIGS. 1–7 of the drawings. As will soon be explained, the connector 20 emulate and, thereby, replaces the conventional circuit board (designated 1 in FIG. 1). Therefore, the disk drive and computer may be more directly and reliably interconected with one another in a manner that will conserve space and reduce cost relative to the space and cost commonly associated by utilizing the conventional circuit board interface. That is to say, and referring to FIG. 2, the connector 20 is adapted to place the pins of the shrouded header of a disk drive into electrical contact with the terminals of a ribbon edge card connector 14. In this manner, the disk drive and a controller card of the personal computer communicate with one another via connector 20, ribbon edge card connector 14, and ribbon cable 16. However, the circuit board 1 of FIG. 1 and its characteristic edge card 2, box connector 4, and printed circuit 8, are eliminated.

Figure 3:
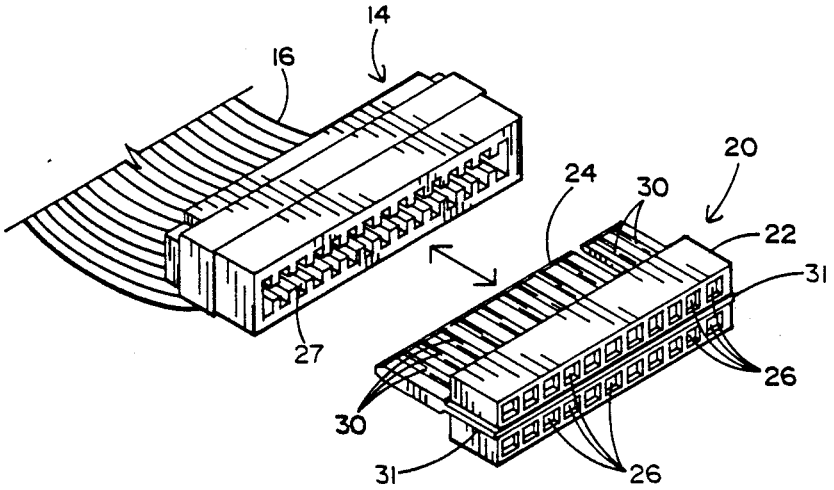
FIG. 3 is an isometric view of the connector interface of FIG. 2.

More particularly, and referring now to FIG. 3 of the drawings, the connector 20 which forms the present invention is shown having a body that is formed from an electrically insulating (e.g. glass filled polyester) material. The body of connector 20 is provided with opposing female and male connector ends 22 and 24. The female end or socket portion 22 of connector 20 includes a plurality of hollow cavities 26 and, thereby, emulates the box connector (designated 4 in FIG. 1) of the conventional circuit board 1. Accordingly, the straight pins from a shrouded header (not shown) which are located at the output of the disk drive are received within respective hollow cavities 26 of socket portion 22. The number of cavities 26 shown in FIG. 3 is for purposes of illustration only, and the actual number of cavities formed in socket portion 22 will depend upon the number of pins which extend from the shrouded header of the disk drive. However, it is common to arrange the pins of the header in a pair of parallel aligned rows. Therefore, the location of the cavities 26 in socket portion 22 is arranged so as to correspond with the position of the header pins.

The male end or plug portion 24 of the body of connector 20 emulates the edge card (designated 2 in FIG. 1) of the conventional circuit board 1. Accordingly, the plug portion 24 of connector 20 is of relatively narrow dimension so as to be received within a receptacle 27 formed in the ribbon edge card connector 14. As will be disclosed in greater detail hereinafter, electrical contacts 30 are located within and aligned by the connector 20 such that said contacts 30 are engaged by respective terminals (not shown) of the ribbon edge card connector 14 when the plug portion 24 of connector 20 is moved into receipt by the receptacle 27 of ribbon edge card connector 14. Of course, it is preferable that the number of electrical contacts 30 to be located within connector 20 and received within receptacle 27 be identical to both the number of pins from the shrouded header and the number of cavities 26 formed in the socket portion 22. In this manner, the disk drive will communicate with the computer via a plurality of continuous electrical paths formed by the pins of the shrouded header, the contacts 30 of connector 20, the ribbon edge card connector 14 and the ribbon cable 16.

A narrow extension or rib 31 projects laterally from opposite sides of the connector 20 so as to maintain uniform spacing of the contacts 30 along the plug portion 24. In addition, the laterally projecting rib 31 serves as a reference plate to faciliate an automatic assembly operation.

Figure 4:
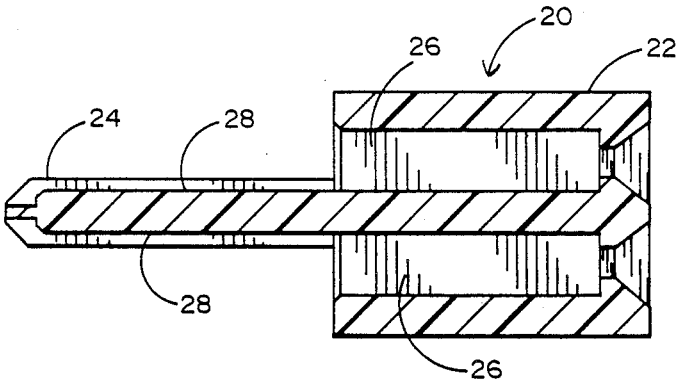
FIG. 4 is a cross section of the connector interface taken along lines 4—4 of FIG. 6.

Referring concurrently to FIGS. 4–7 of the drawings, details of the connector 20 and the contact 30 thereof are illustrated for interconnecting the previously described shrouded header and ribbon connector. As was also previously described, a particular number of contacts 30 (corresponding with the number of output pins from the shrouded header) are received within rerspective hollow cavities 26 at the socket portion 22 of the connector 20. As is best shown in FIGS. 4 and 6, the cavities 26 are spaced from one another and arranged in a pair of parallel aligned rows at the interior of the socket portion 22, so that the pins of the shrouded header may be more easily inserted therewithin.

As is best shown in FIGS. 4 and 7, the plug portion 24 of connector 20 has a plurality of longitudinally extending channels 28 formed therein. The channels 28 are spaced from one another and arranged in a pair of parallel aligned rows along opposite sides of plug portion 24. The channels 28 of the plug portion 24 communicate with respective cavities 26 of the socket portion 22 so that an individual contact 30 may be located and retained within a continuously extending and axially aligned cavity 26 and channel 28.

Figure 5:
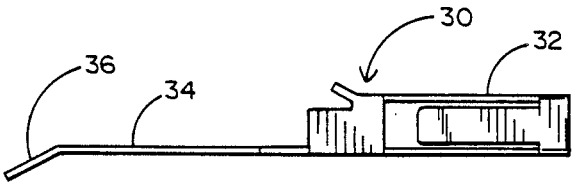
FIG. 5 is a side view of the contact which is located within the connector interface of the present invention.

The details of the contacts 30 which are located within the connector 20 are described while referring particularly to FIG. 5. The contact 30 is fabricated from a resilient, electrically conductive material, such as aluminum, or the like. Each contact 30 has a hollow, generally cylindrical barrel member 32 formed at one end thereof and an elongated blade member 34 coextensively formed with barrel member 32 at the opposite end. The blade member 34 is bent or slightly deflected (e.g. at an angle of about 30) to form a tail 36 at the end of blade member 34.

In the assembled relationship, and referring concurrently to FIGS. 4 and 5, a contact 30 is located within the connector 20 such that the barrel member 32 is received within a cavity 26 at the interior of socket portion 22. The blade member 34 of contact 30 is received within a longitudinally extending groove 28 formed in the plug portion 24, whereby blade member 34 emulates and replaces the printed circuit 8 of the conventional printed circuit board 1 of FIG. 1. The end of plug portion 24 is suitably chamfered so as to receive the bent tail 36 of blade member 34. Inasmuch as a pair of parallel rows of axially aligned and continuously extending cavities 26 and channels 28 extend through connector 20, the contacts 30 which fill each row are arranged such that the blade members 34 thereof are retained in opposing, face-to-face alignment with one another (i.e. with tails 36 angled towards one another at opposite sides of the plug portion 24). Therefore, a reliable electrical connection can be made between the connector 20 and the receptacle 27 of the ribbon edge card connector 14 (of FIG. 3).

To this end, and referring briefly once again to FIG. 3, when the plug portion 24 of connector 20 is moved into the receptacle 17 of ribbon edge card connector 14, the blade members 34 of contacts 30 engage respective terminals located within said receptacle 27. When the straight pins of the shrouded header of the disk drive are moved through the cavities 26 at the interior of socket portion 22, said pins are received within respective barrel members 32 of contacts 30. Accordingly, the disk drive can be more directly and reliably connected to the ribbon cable 16 via connector 20 and ribbon edge card connector 14. Since the connector 20 and its contacts 30 emulate the box connector, edge card, and printed circuit of a conventional circuit board which has heretofore been used to interface a disk drive and personal computer, said circuit board may now be eliminated, whereby to advantageously reduce costs and minimize space consumption.

It will be apparent that while a preferred embodiment of the invention has been shown and described, various modifications and changes may be made without departing from the true spirit and scope of the invention. For example, the presently disclosed connector 20 has particular advantage with the advent of the 3½ inch disk drive, especially for a conversion kit which permits a user to replace a standard 5¼ inch disk drive with the new 3½ inch disk drive. The present connector 20 allows the 3½ inch disk drive to be more efficiently retrofit to a personal computer. What is more, it is within the scope of the present invention to make the connector 20 without the longitudinally extending channels 28 in the plug portion 24 so as to correspondingly reduce the cost of manufacture.

Having thus set forth a preferred embodiment of the invention, what is claimed is:

1. A connector for interfacing a disk drive with a computer, said connector comprising:

a socket portion in which a series of hollow cavities are formed;

a plug portion extending from said socket portion and having a series of longitudinally extending channels formed therein, the channels of said plug portion being axially aligned with respective hollow cavities of said socket portion; and a plurality of contacts, each contact having a first end received in a hollow cavity of said socket portion to communicate with said disk drive and a second end located in a channel of said plug portion to communicate with said computer.

2. The connector recited in claim 1, wherein the first end of each of said contacts is a hollow, generally cylindrical barrel member for receiving a respective output pin from said disk drive.

3. The connector recited in claim 1, wherein the second end of each of said contacts is a blade member that is to be connected to a corresponding terminal of said computer.

4. The connector recited in claim 1, wherein the first end of each of said contacts is a hollow, generally cylindrical barrel member for receiving a respective output pin from said disk drive, and the second end of each of said contacts is a blade member to be connected to a corresponding terminal of said computer.

5. The connector recited in claim 4, wherein the barrel members of said contacts at said socket portion are aligned to receive respective output pins from a header of said disk drive.

6. The connector recited in claim 4, wherein said plug member is sized to be received within an electrical receptacle of a ribbon connector having a series of contacts which communicate with said computer by way of a ribbon cable, the blade members of said contacts at said plug portion engaging respective contacts of said ribbon connector so that said blade members are in electrical contact with said computer via said ribbon connector and the ribbon cable thereof.

7. The connector recited in claim 1, wherein the cavities at said socket portion are spaced from one another and arranged in two parallel aligned rows.

8. The connector recited in claim 1, wherein the longitudinally extending channels formed in said plug portion are spaced from one another and arranged in two parallel aligned rows.

9. The connector recited in claim 1, wherein said plurality of contacts are spaced from one another and arranged in two parallel aligned rows, such that the second ends of the contacts in said first row lie in spaced opposition to the second ends of the contacts in the second row.

10. A connector to permit the output pins from a disk drive to be electrically connected to a computer by way of a ribbon connector and a ribbon cable, said connector comprising:

a socket portion in which a series of spaced, hollow cavities are formed for receiving respective output pins from said disk drive;

a plug portion extending from said socket portion for receipt within a receptacle of said ribbon connector; and a plurality of contacts, each contact having a hollow barrel end located at one of said said series of cavities formed in said socket portion to receive a respective pin from said disk drive that is received within said cavity and a blade end supported by said plug portion so as to engage a respective contact located at the interior of the receptacle of said ribbon connector.

11. The connector recited in claim 10, further comprising a series of longitudinally extending channels formed in said plug portion for receiving therein respective blade ends of said plurality of contacts, so that said blade ends are aligned for engagement with respective contacts located at the receptacle of said ribbon connector, when said plug portion is inserted within said receptacle.

12. The connector recited in claim 11, wherein the longitudinally extending channels formed in said plug portion are spaced from one another and arranged in two parallel aligned rows.

13. The connector recited in claim 10, wherein the cavities of said socket portion are arranged in two parallel aligned rows.

14. The connector recited in claim 10, wherein said plurality of contacts are spaced from one another and arranged in two parallel aligned rows, such that the blade ends of the contacts in said first row lie in spaced opposition to the blade ends of the contacts in said second row.

15. The connector recited in claim 10, wherein said plug portion has a dimension which is narrow relative to the same dimension of said socket portion, such that only said plug portion is sized to be received within the receptacle of said ribbon connector.

* * * * *